US005497952A

United States Patent [19]

Iding

[11] Patent Number: 5,497,952

[45] Date of Patent: Mar. 12, 1996

[54] AUTOMATIC BOBBIN WINDER HAVING PROCESSORS FOR YARN END PREPARATION INFORMATION

[75] Inventor: Michael Iding, Geldern, Germany

[73] Assignee: W. Schlafhorst AG & Co., Moenchengladbach, Germany

[21] Appl. No.: 213,495

[22] Filed: Mar. 14, 1994

[30] Foreign Application Priority Data

Mar. 24, 1993 [DE] Germany ..... 43 09 582.8

[51] Int. Cl.[6] ..... B65H 54/00; B65H 9/04

[52] U.S. Cl. ..... 242/18 R; 57/90; 57/281; 57/264; 242/35.5 A; 242/35.6 E; 242/130

[58] Field of Search ..... 242/35.5 A, 18 R, 242/35.6 E, 130; 57/281, 90, 264

[56] References Cited

U.S. PATENT DOCUMENTS

| | | | |
|---|---|---|---|
| 5,056,725 | 10/1991 | Wirtz et al. | 242/35.5 A |
| 5,170,954 | 12/1992 | Derichs | 242/35.5 A |
| 5,240,193 | 8/1993 | Backhaus | 242/35.5 A |
| 5,269,478 | 12/1993 | Wakabayashi et al. | 242/35.5 A |
| 5,287,692 | 2/1994 | Matsubayashi | 242/35.5 A |
| 5,288,030 | 2/1994 | Wirtz et al. | 242/18 R |
| 5,359,160 | 10/1994 | Wirtz | 57/281 |
| 5,375,691 | 12/1994 | Wirtz | 242/35.5 A |

FOREIGN PATENT DOCUMENTS

| | | |
|---|---|---|
| 3732367 | 11/1988 | Germany . |
| 3902181 | 8/1989 | Germany . |
| 3912030 | 10/1990 | Germany . |
| 3919542 | 12/1990 | Germany . |
| 3925861 | 2/1991 | Germany . |
| 4025003 | 2/1992 | Germany . |
| 4038970 | 6/1992 | Germany . |
| 4041713 | 6/1992 | Germany . |
| 302412 | 10/1971 | U.S.S.R. . |

*Primary Examiner*—William Stryjewski
*Attorney, Agent, or Firm*—Shefte, Pinckney & Sawyer

[57] ABSTRACT

An automatic bobbin winder having a plurality of transport loops which have partially common transport tracks for bobbins is improved by the present invention wherein an electronic memory device is associated with the respective textile bobbin, as a carrier of product information. A monitoring apparatus for monitoring the success of the preparation of returned textile bobbins is provided at a first preparation device and is connected with a writing device for writing in the successful preparation into the memory device. A communication device for reading the information written in as the acknowledgement of successful preparation is provided at a second preparation device for textile bobbins to be fed to the bobbin winder. The communication device is connected with a control apparatus for the start-up of the second preparation device in the absence of the information acknowledging the successful preparation at the first preparation device.

8 Claims, 2 Drawing Sheets

AUTOMATIC BOBBIN WINDER HAVING PROCESSORS FOR YARN END PREPARATION INFORMATION

BACKGROUND OF THE INVENTION

The present invention relates generally to an automatic bobbin winder with a plurality of transport loops for bobbins which have partially common transport paths, and more particularly, to an automatic bobbin winder having multiple yarn package preparation devices disposed along the transport paths and an apparatus for coordinating the operation thereof.

A conventional bobbin winder of the general type employed with the present invention is disclosed in U.S. Pat. No. 5,056,725. In addition to a main transport loop, through which most of the bobbins, also known as yarn packages, or cops, are being transported, the transport system of the bobbin winder also includes a separate path by which textile bobbins which are not completely empty are transported from a return path to a feed path.

The bobbin winder includes two yarn package preparation devices for seeking the yarn end and placing it in a predetermined location, accessible by a winder. A first yarn package preparation device is disposed on the separate transport path, which prepares yarn packages for winding by searching for threads on bobbins still containing some yarn. A complete preparation is performed at this preparation device, i.e., after a thread search the thread is deposited at a predetermined location in a manner whereby it can be readily grasped at the winding position and brought to a second yarn package preparation device which is disposed at the feed path and is particularly suited for preparing full cops. First, the start of the thread on these cops is sought in the area of the base of the cop located and loosened, while the main part of this preparation device performs a so-called sheath preparation which involves searching for the thread start on the main wound body. If a cop which was completely prepared in the first preparation device reaches the second preparation device, the thread start can be found neither at the cop base nor on the main wound body, because it has been deposited either in the form of top windings at the tube top or in the tube. The second preparation device can waste time and energy attempting to prepare a cop which was fully prepared at the first preparation device. Therefore, it is desired to have a device or apparatus for determining whether a cop has been prepared successfully at the first preparation device and communicating this information to the control unit for the second preparation device so that operations of the second preparation device can be controlled accordingly.

SUMMARY OF THE INVENTION

It is therefore an object of the present invention to provide a bobbin winder wherein the preparation of the textile bobbins for the winding process is coordinated between the first and second package preparation devices.

It is a another object of the present invention to provide an apparatus for communicating to the second preparation device whether yarn packages have been successfully prepared at the first yarn preparation device.

It is further an object of the present invention to provide information to the second preparation device regarding the successful preparation of each individual cop of the first preparation device.

In accordance with the present invention, the preparation of textile bobbins at the second preparation device, through which pass all textile bobbins to be fed to all winding stations, is only performed if the cops have not yet been prepared. This concerns cops which are newly fed to the bobbin winder or which were ejected only partially unwound from a winding station and which then could not be prepared in the first preparation device for returned cops. However, textile bobbins which had been completely prepared in the first preparation station are no longer processed in the second preparation station, passing instead through the second preparation station unimpeded.

To that end, an automatic bobbin winder of the general type discussed herein includes an electronic memory device associated with each package, or cop, for retaining therein yarn end preparation information for the package with which the memory device is associated, an apparatus for sensing whether a yarn end has been successfully prepared on a package at the first yarn preparation device and a first communication device for communicating that information to the electronic memory device for retention thereby. The present invention further includes a second communication device associated with the second preparation device for communication with the electronic memory device to determine whether a package has been successfully prepared at the first preparation station. Finally, a control arrangement is associated with the second preparation device and communicates with the second communication device for deactivation of the second preparation device responsive to information from the memory device indicating that a successful package preparation has occurred at the first preparation device.

Since all textile bobbins fed to the bobbin winder pass through the second preparation device, speed is a factor in successful winding operations, therefore, duplication of efforts at the preparation devices is to be avoided. Since thread searching is not limited to a special area, in most cases it is necessary to loosen underwindings in the area of the cop base prior to searching for the thread start on the main winding body of the textile bobbin. It is possible that it will also be necessary to loosen a relatively steeply extending reserve winding leading to the base windings. For this reason, this second preparation device, in most cases, consists of a plurality of individual stations which are assigned different functions. Since no thread searching steps are intended to be taken on already prepared textile bobbins, control on the basis of information regarding the performed preparation must extend to all stations.

It is therefore preferred that each station have a control arrangement associated therewith and the second communication device is disposed adjacent the first of the plurality of stations and communicates with each station control device for sequential deactivation of each station. Optionally, the deactivation may be performed out of sequence. As a further option, electronic memory devices can be disposed at each station with each individual station communication device being in communication with the control device disposed at each station with which the respective communication device is located for selective deactivation of individual stations.

If the second preparation station is also provided with a device for monitoring the success of preparation in this preparation station, care must be taken that in connection with cops arriving completely prepared from the first preparation station, this monitoring device receives an indication of their successful preparation and that the second preparation device is placed in the state which it attains in case of a positive result of its own checking. As a result, it is to be avoided that these textile bobbins are classified as not prepared and are prevented from being fed to the bobbin winder. To that end, the second preparation device includes an apparatus for determining whether packages prepared thereat are prepared successfully, the determination apparatus being in communication with the second communication device for placing the second preparation device in a deactivated condition whether the package was successfully prepared at either the first preparation device or the second preparation device.

Optionally, the bobbin winder may include a plurality of individually operative second preparation devices and each of the second preparation devices may include a second communications apparatus for communication with the electronic memory device. Further, each second preparation device may include a control arrangement communicating with the second communication device for controlled deactivation of the second preparation device associated therewith, responsive to an indication from the electronic memory device through the second communication apparatus indicating the package with which the electronic memory device is associated has been successfully prepared.

Finally, the improved automatic bobbin winder of the present invention is particularly useful wherein textile yarn packages are disposed on individual tube support members and the transport paths include a plurality of endless belts trained around drive rollers and the tube support members are transported by the endless belt. Preferably, the electronic memory devices are disposed on each tube support member.

By the above, the present invention provides an automatic bobbin winder of enhanced efficiency wherein information regarding the successful preparation of yarn ends at first package preparation device is communicated to the second preparation device which can be controlled to remain unactivated as the packages successfully prepared at the first yarn preparation device pass thereby.

DESCRIPTION OF THE PREFERRED EMBODIMENT

Figure 1A:
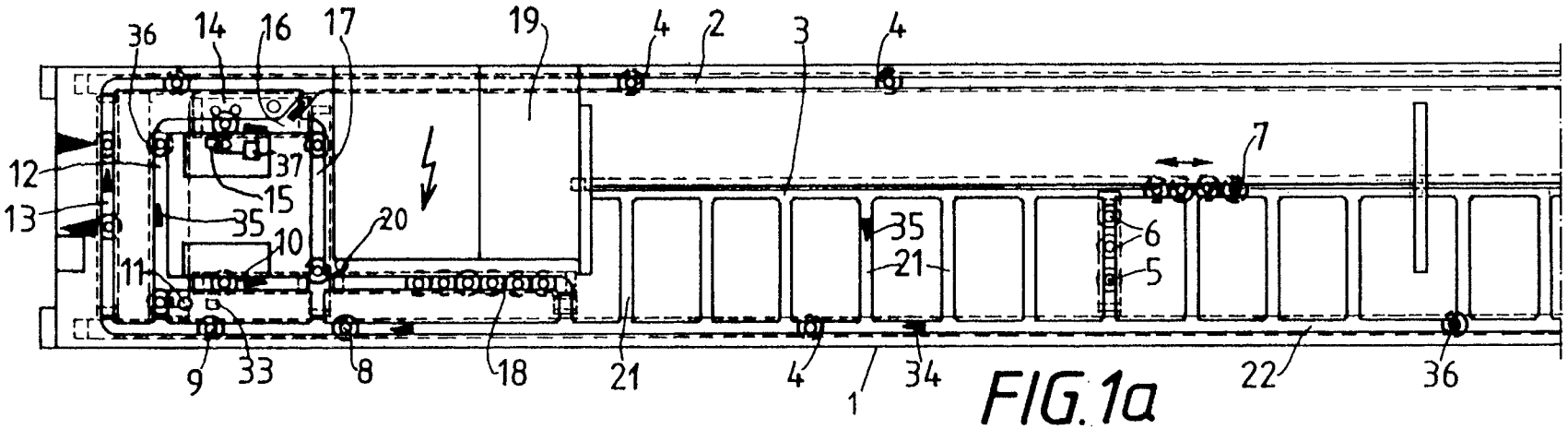
FIG. 1*a* illustrates a first portion of a transport system for an automatic bobbin winder according to the preferred embodiment of the present invention.

Turning now to FIGS. 1*a* and l*b*, textile bobbins illustrated in the form of cops are transported in a bobbin winder 1. For this purpose, the bobbin winder 1 has a cop and tube transport system with a plurality of transport loops which have partially common transport paths. The transport paths are formed with endless belts trained around rollers, at least one of which is driven. Tube support members 4 carrying the cops or bobbin tubes are transported on these transport paths. For reasons of clarity, the cops or bobbin tubes are not shown.

Figure 1B:
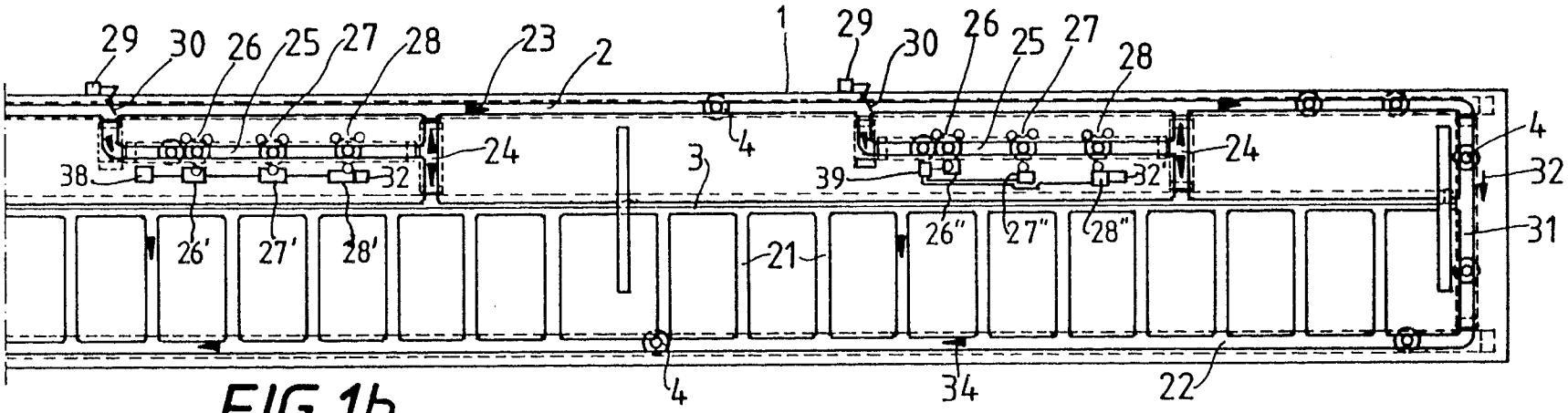
FIG. 1*b* illustrates the remaining portion of the transport system of the automatic bobbin winder illustrated in FIG. 1*a*.

A feed track 2 for feeding cops to the winding stations extends along the entire bobbin winder 1. With reference to FIG. 1*b*, preparation sections 25 branch off the feed path 2 and lead to second preparation devices constituted by preparation stations 26,27,28. These preparation stations 26,27,28 perform a conventional stepped preparation of the cops as described in U.S. Pat. No. 5,056,725. A distributing path 24 is provided at the end of the preparation section 25, which feeds the cops alternatingly to a reversing belt 3 or, optionally, again to feed track 2. This distributing path 24 is activated by the respectively last preparation station 28, which has a monitoring device (not shown) for monitoring the success of the cop preparation. If the cop has been successfully prepared, the directionally reversible distributing path 24, brings it to the aforesaid reversing belt 3. If it was not possible to successfully prepare the cop, the tube support member 4 carrying it is guided to the feed track 2 which either guides it to the next preparation section 25 or, around the end of the bobbin winder 1 via the bypass track 31 to the return path 22. This return path 22 also extends along the entire bobbin winder 1 parallel to the feed path 2. The distribution of the cops to the various preparation sections 25 will be described in greater detail below.

The reversing belt 3 is reversed in its transport direction at predetermined time periods and distributes the cops fed to it to the transport path 21 leading through the winding stations 5. Two additional reserve positions 6 for the tube support member 4 carrying the cops are provided between the respective winding position 5, i.e., the unwinding position of the respective cop, and the reversing belt 3. Groups 7 of tube support members 4 with cops are moved along the reversing belt 3 and then enter a transport path 21 leading through the winding position 5 if the final reserve position 6 is not occupied. Details of this operation can also be found in U.S. Pat. No. 5,056,725. In this context, it should also be pointed out that for reasons of clarity only a small portion of the circulating tube support members 4 has been shown. In particular, the transport paths 21 should in most cases be occupied by three tube support members 4, as is illustrated by a transport path illustrated in FIG. 1*a* at 21.

Hereinafter, the transport paths 21 at the downstream end of the return track 22, along with the associated processing stations, will be described in greater detail.

A rest cop 9, which has a remaining amount of threads which can be further processed, is located next to a remaining thread detector 33 which detects thread still present on the cop 9. The remaining thread detector 33 controls an electromagnet 11, which acts on an iron ring on the tube support member 4 and detours the tube support member 4 from the return path 22 to a side transport track 12. On this side transport path 12, the rest cop 9 then reaches the first preparation device 14, which searches for a yarn end on the cop, independently of yarn end position, and places it in such a way that it can later be grasped at the winding position. Accordingly, the first preparation device 14 performs a complete preparation of the cop. A cop prepared in this manner is then routed to the feed path 2 via a connector path 16. However, the first preparation device 14 has a thread sensor 15 for determination of the success of the yarn end preparation. If the rest cop 9 could not be successfully prepared, it reaches a storage section 18 via a feed path 17. The layout of such a cop preparation station can be found in U.S. Pat. No. 5,288,030.

Figure 2:
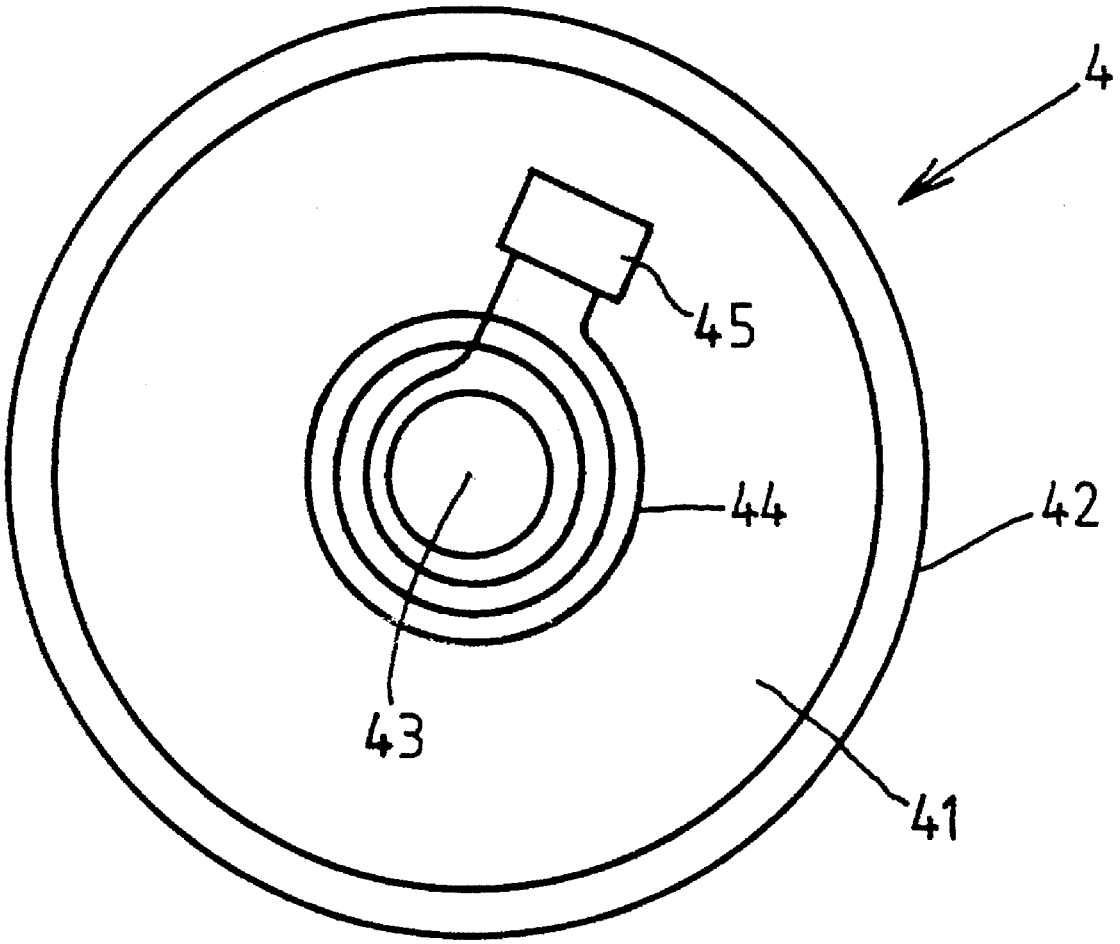
FIG. 2 is a bottom plan view of a yarn tube support member according to the preferred embodiment of the present invention.

A successful preparation detected by the thread sensor 15 is transmitted to an electronic communication device 37 which communicates this information to an electronic memory chip disposed on the tube support member 4. The arrangement of a memory chip on the tube support member 4, including the apparatus for wireless data exchange is illustrated in FIG. 2. There, a yarn tube support member 4 is shown in plan view from the bottom of the circular base plate 41 of the tube support member 4. The base plate 41 is formed with a circumferential beveling 42 about its bottom face which serves, for example, to overcome inconsistencies or other potential impediments in a conveyor or other transport path for the tube support member 4. As is conventional, the tube support member 4 has an axially upstanding pin (not shown in FIG. 2) extending centrally from the top side of the base plate 41 for telescopical mounting thereon of a textile yarn tube (also not shown). A central bore 43 is formed axially in the bottom face of the tube support member 4 and extends through the tube supporting pin thereof. This bore 43 serves for blowing out the start of a yarn wound on the supported textile yarn tube which yarn is to be supplied, for example, to yarn connecting members of a winding head. The base plate 41 of the tube support member 4 carries an information signal transmitting-receiving device preferably in the form of an antenna coil 44 formed in a spiral winding concentric with the axis of the tube support member 4 and connected at the opposite ends of the coil to a memory chip 45 also carried on the base plate 41. The coil 44 can advantageously be printed or otherwise formed in a simple manner and arranged jointly with the memory chip 45 on a silicon platelet or wafer.

In order to assure an effective transmission of information to and from the coil 44 and memory chip 45 during transport of the tube support member 4, a compatible information signal transmitting-receiving device capable of reading, erasing, and encoding the memory chip 45, preferably including a corresponding antenna coil (not shown), should be stationarily arranged along the transport path of the tube support member 4 to enable an inductive coupling of the coil 44 on the tube support member 4 with the coil. In this manner, the transmission of information can readily take place from beneath the tube support member 4 through a conveyor belt in the transport path by which the tube support member 4 is supported and transported. Further details of this structure are disclosed in German Patent Publication DE 40 41 713 A1, while the operation of the data exchange is described in German Patent Publication DE 40 38 970 A1.

A tube 8 with a small amount of thread remaining, which passes next to an end frame 19, is also identified as such by the remaining thread detector 33. The tube support member 4 carrying it is then rerouted into the side transport path 12 by the electromagnet 11. However, immediately following this the tube 8 is again rerouted and reaches a tube cleaning device 10. An electromagnet which is additionally triggered by the remaining thread detector 33 may also be disposed at this branch. The cleaned tube 8 then again reaches the return path 22 through an intersection 20 or, following unsuccessful cleaning, it reaches the storage section 18 as disclosed in U.S. Pat. No. 5,056,725.

A completely empty tube 36 ejected from a winding position 5 may also be brought on the return path 22 to the remaining thread detector 33 which in this case does not switch on the electromagnet 11 so that the tube support member 4 carrying the empty tube 36 reaches the transport path 13 on which the empty tube 36 is exchanged for a fresh cop coming from the spinning frame. This cop then again reaches the feed path 2 and, in the manner described, its unwinding station in the bobbin winder 1.

Turning now to FIG. 1*b*, sensors 29 which control selectively operable directing gates 30 are disposed at the respective branchings from the feed path 22 to the preparation sections 25. These directing gates 30 are provided for distributing the cops to the preparation sections 5. The bobbin winder 1, as illustrated in FIG. 1*b*, includes two second preparation stations but it is contemplated that a bobbin winder according to the present invention could include more than two second preparation devices. With two second preparation devices 25, as illustrated, the directing gate 30 disposed at the first branch in the feed direction of the cops would alternatingly let every second cop pass, which is then moved on the feed path 2 to the next second preparation device 25 as indicated by directional arrow 23. Similarly, it is possible to switch over after respectively two or more cops, as required.

If a cop, the tube support member 4 of which contains a memory chip bearing information regarding the successful preparation in the first preparation device 14, reaches the first preparation section 25 in the downstream direction, this information is read by a second communication device 38. This second communication device 38 transmits this information to a control apparatus 26' disposed at the first preparation station 26 associated with the second preparation device 25. The control apparatus, which controls the start-up of the station 26, includes a stop or a drive device acting to prevent the start-ups of the preparation station 26. As a result, the tube support member 4 passes freely through the preparation station 26.

In this case, the control apparatus 27' and 28', also present in the succeeding preparation stations 27 and 28, are triggered by the respectively upstream disposed control apparatus in a manner that they similarly permit the passage of the already prepared cop.

The information regarding the already-performed preparation is furthermore transmitted by the control apparatus 28' to a thread sensor 32, disposed in the preparation station 28. In this case, in addition to recognition of the successful preparation in the preparation station 28, this thread sensor 32 then triggers the distribution track 24 in a manner to direct the cop to the reversing path 3.

Alternatively, a reading device 39 may be disposed at the downstream preparation section 25, which triggers the control apparatus 26", 27", 28" directly, but sequentially responsive to a time delay. The thread sensor 32' present at the preparation station 28 is triggered similarly to the thread sensor 32.

It is also possible within the scope of the invention to dispose a reading device at each preparation station 26,27, 28, each of which cooperate with the control apparatus 26", 27", 28". In this way, time-delayed sequencing control of the control apparatus is omitted. A separate illustration of this example was not provided, because a circuit like the one between the reading device 39 and the control apparatus 26" would also be provided at the other two preparation stations 27 and 28, which has been explained by the foregoing description.

In principle, to determine whether a successful preparation has occurred, it is assumed that with a previously detected thread end grasped inside a suction tube, the deposition of this thread end at the position provided therefor takes place in a correct manner. Accordingly, the detection of the thread end by the respective thread sensor is considered to be equal to the successful complete preparation of the cop. However, this does not preclude that possibly other monitoring devices can be employed within the scope of the instant invention for a successful preparation of a textile bobbin.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an automatic bobbin winder having a plurality of transport loops with partially common transport paths for the circulation of a plurality of supported textile yarn packages and having first and second package preparation devices for locating and positioning a yarn end on a package for engagement at a winding station, the improvement comprising:

electronic memory means associated with each package for retaining therein yarn end preparation information for the package with which said memory means is associated;

means for sensing whether a yarn end has been successfully prepared on a package at the first preparation device;

first communication means for communicating said yarn end preparation information for the package associated with said electronic memory means to said electronic memory means for retention thereby;

second communication means associated with said second preparation device for communication with said electronic memory means to determine whether a package has been successively prepared at the first preparation station; and control means associated with the second preparation device and communicating with said second communication means for deactivation of said second preparation device responsive to information from said memory means indicating a successful package preparation by said first preparation device.

2. An improved automatic bobbin winder according to claim 1, wherein said second preparation device includes a plurality of stations generally aligned along a package transport path, each station having control means associated therewith and said second communication means being disposed adjacent the first of said plurality of stations and communicating with each said each station control means for sequential deactivation thereof.

3. An improved automatic bobbin winder according to claim 1, wherein said second preparation device includes a plurality of stations generally aligned along a transport path, and said second communication means is disposed adjacent the first of said plurality of stations and is associated with control means for the deactivation of each station.

4. An improved automatic bobbin winder according to claim 1, wherein said second preparation device includes a plurality of stations generally aligned along a transport track, each said station having control means associated therewith and said second communication means includes individual means for communicating with said electronic memory means disposed at each said station with each said individual station communication means being in communication with said control means disposed at each said station with which the respective communication means is associated for selective deactivation of individual stations.

5. An improved automatic bobbin winder according to claim 1, wherein said second preparation device includes means for determining whether packages prepared thereat are prepared successively, said determination means being in communication with said second communication means for placing said second preparation device in a deactivated condition whether the package was successfully prepared.

6. An improved automatic bobbin winder according to claim 1, wherein the bobbin winder includes a plurality of individually operative second preparation devices and each said second preparation device includes second communication means for communication with said electronic memory means and each said second preparation device includes control means communicating with said second communication means for controlled deactivation of said preparation device associated therewith responsive to an indication from said electronic memory means through said second communication means indicating the package with which said electronic memory means is associated has been successfully prepared.

7. An improved automatic bobbin winder according to claim 1, wherein said textile yarn packages are disposed on individual tube support members, said transport loops include a plurality of endless belts trained around drive rollers and the tube support members are transported by said endless belts.

8. An improved bobbin winder according to claim 7, wherein said electronic memory means is disposed on said tube support members.

* * * * *